US008419266B2

(12) United States Patent
Velayutham et al.

(10) Patent No.: US 8,419,266 B2
(45) Date of Patent: Apr. 16, 2013

(54) SYSTEM AND METHOD FOR FACILITATING WELL SERVICING OPERATIONS

(75) Inventors: Saravanan Velayutham, Stafford, TX (US); Hau Nguyen-Phuc Pham, Houston, TX (US); Laurent Coquilleau, Houston, TX (US); Stuart K. Taylor, Skiatook, OK (US); Brian Goddard, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 371 days.

(21) Appl. No.: 12/470,637

(22) Filed: May 22, 2009

(65) Prior Publication Data

US 2010/0296359 A1 Nov. 25, 2010

(51) Int. Cl.
*B28C 5/00* (2006.01)

(52) U.S. Cl.
USPC ..... 366/2; 366/6; 366/42

(58) Field of Classification Search ..... 366/2, 6, 366/42
See application file for complete search history.

(56) References Cited

U.S. PATENT DOCUMENTS

| | | | | |
|---|---|---|---|---|
| 2,320,509 | A | 7/1940 | Cook | |
| 2,867,314 | A * | 1/1959 | Hansen | 119/57.7 |
| 3,272,397 | A * | 9/1966 | Bean | 222/200 |
| 4,239,396 | A * | 12/1980 | Arribau et al. | 366/2 |
| 4,311,395 | A | 1/1982 | Douthitt et al. | |
| 5,013,157 | A * | 5/1991 | Mills et al. | 366/13 |
| 5,426,137 | A * | 6/1995 | Allen | 523/318 |
| 5,796,052 | A | 8/1998 | Christmann | |
| 6,056,109 | A | 5/2000 | Hidai et al. | |
| 6,397,999 | B1 | 6/2002 | Taylor | |
| 6,481,563 | B1 | 11/2002 | Gilmore | |
| 6,571,938 | B2 | 6/2003 | Gilmore | |
| 6,668,979 | B2 | 12/2003 | McQuaid et al. | |
| 6,805,229 | B2 | 10/2004 | Dekoning | |
| 6,823,985 | B2 | 11/2004 | Gilmore et al. | |
| 7,012,210 | B2 | 3/2006 | Kibbler et al. | |
| 7,216,013 | B2 | 5/2007 | Kibbler | |
| 7,351,026 | B2 | 4/2008 | Ash | |
| 7,428,956 | B2 | 9/2008 | Scherman | |
| 7,455,173 | B1 | 11/2008 | Fridman et al. | |
| 7,470,099 | B2 | 12/2008 | Bengtsson | |
| 7,669,911 | B1 * | 3/2010 | Hankey | 296/100.1 |

FOREIGN PATENT DOCUMENTS

| | | | |
|---|---|---|---|
| EP | 0482930 | A2 | 4/1992 |
| GB | 949446 | A | 2/1964 |
| WO | WO 9623639 | A1 * | 8/1996 |

* cited by examiner

*Primary Examiner* — Joseph Del Sole
*Assistant Examiner* — James Sanders
(74) *Attorney, Agent, or Firm* — Matthias Abrell

(57) ABSTRACT

A technique facilitates well servicing operations by utilizing a hopper system to introduce a dry additive into a mixing tank. The hopper system comprises a feeder and a hopper that delivers the dry additive into the feeder. The feeder, in turn, enables introduction of the dry additive into the cement mixing tank in a controlled manner. When the hopper system is used on a transportable cementing unit, the hopper system may be mounted on a cement mixing tank and also may incorporate a hopper that is both expandable to accommodate a greater amount of dry additive and contractible to facilitate transport.

16 Claims, 5 Drawing Sheets

SYSTEM AND METHOD FOR FACILITATING WELL SERVICING OPERATIONS

BACKGROUND

In many well applications, various well cementing operations are performed. To improve the integrity of the cement material, fiber products acting as fluid-loss reduction additives can be added to the cement slurry that is pumped downhole. The fiber products typically are added by hand or with toothed drums. However, such techniques can lead to uneven metering of the fiber products into the cement mix. Additionally, toothed drums and other field-improvised equipment can be inadequate due to insufficient delivery rate, lack of reliability, and lack of accuracy.

Additionally, any equipment used to deliver fiber material into the cement mixing tank can present a problem with respect to height of the equipment. When equipment is mounted on top of a portable well servicing unit, for example, the equipment is susceptible to extending beyond the legal height requirements that must be met when transporting equipment over a highway system.

SUMMARY

In general, a system and methodology is provided that facilitate well servicing operations, such as cementing operations. A hopper system is designed to introduce an additive into a cement mixing tank. The hopper system comprises a feeder and a hopper that delivers the additive into the feeder. The feeder, in turn, enables introduction of the additive into the cement mixing tank in a controlled manner. When the hopper system is used on a transportable cementing unit, the hopper system may be mounted on a cement mixing tank. In this type of application, the hopper also may be expandable to accommodate a greater amount of additive and contractible to facilitate transport.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present disclosure relates to a system and methodology to facilitate well cementing operations. The system and methodology employ a hopper system that comprises a unique feeder to meter additives, e.g. dry additives, into a cement mixing tank. The additives are mixed into a cement slurry which can then be pumped downhole to perform a variety of well related cementing operations. The hopper system works well with additives having fibers, and other fibrous fluid-loss reduction agents. According to one embodiment, the feeder has a screw-type design of appropriate geometry and material selection to enable a precisely controlled metering rate and to improve reliability and accuracy with respect to the metering of fibrous fluid-loss reduction additives for well cementing work.

Additionally, the hopper system may be designed to facilitate ease of operation at a well site while allowing transport of the hopper system when mounted to a transportable cementing unit. For example, the hopper system may be part of a well servicing system having a transportable cementing unit mounted on a truck or trailer for transport over public highway systems. In some embodiments, the hopper system is mounted on top of a cement mixing tank which forms part of the transportable cementing unit. In this embodiment, the hopper system comprises a hopper positioned above the feeder, and the hopper can be selectively expanded in capacity to, for example, hold one sack of additive, e.g. fiber additive, or another desired quantity of additive. The hopper also can be selectively contracted to reduce the height of the overall transportable cementing unit to ensure the overall transportable unit meets legal road height limits. The hopper may be extended during a well cementing operation and retracted after the operation for transport.

Figure 1:
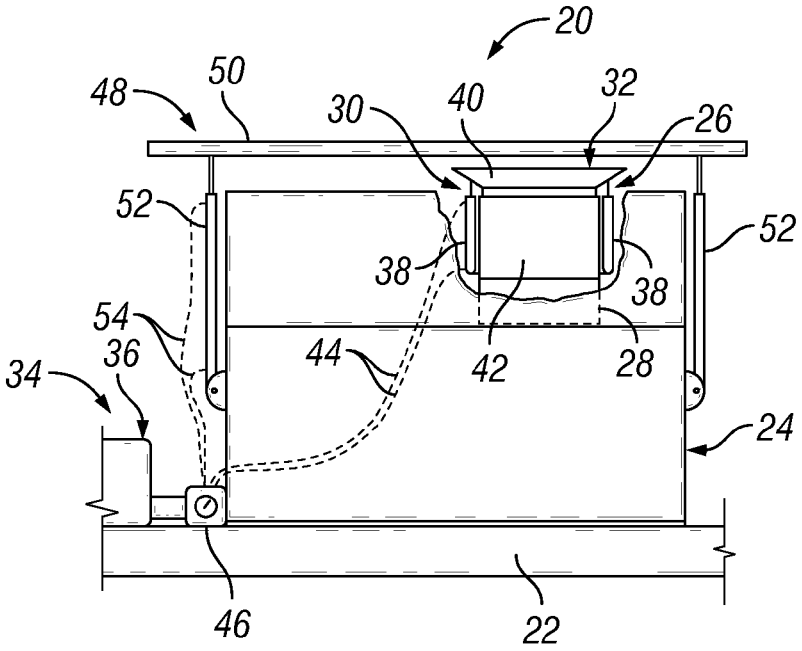
FIG. 1 is a schematic illustration of an embodiment of a transportable cementing unit.

Referring generally to FIG. 1, an embodiment of a transportable well servicing unit 20, such as a transportable cementing unit, is illustrated. In this embodiment, the transportable cementing unit 20 may be part of a truck or trailer that enables transport along a public highway system. It should be noted that the transportable unit may comprise a variety of other components, systems and features to facilitate well cementing operations and other well servicing operations. However, relevant portions of transportable cementing unit 20 have been illustrated in FIG. 1 to facilitate explanation of the present system and its operation in conducting well cementing operations.

In the embodiment illustrated, transportable cementing unit 20 comprises a platform 22 that may be a trailer or truck bed designed to transport the cementing unit 20 over public highways and other types of roads. The transportable cementing unit 20 further comprises a cement mixing tank 24 and a hopper system 26 mounted on the cement mixing tank 24. The cement mixing tank 24 is designed to mix a desired cement slurry that may be pumped downhole into a wellbore via a pumping system mounted on platform 22 or on a separate transportable platform. The cement slurry is pumped into the wellbore and delivered to specific regions of the wellbore to accomplish the planned cementing operation.

The hopper system 26 may be used to deliver additives into cement mixing tank 24. For example, dry additives may be added to the cement slurry to provide the cement slurry with characteristics that improve the quality of the cementing job. In a variety of applications, the additive comprises a fibrous fluid-loss reduction additive that substantially improves the functionality of the cement downhole.

In the embodiment illustrated, hopper system 26 comprises a feeder 28 mounted, for example, directly above the cement mixing tank 24 to precisely meter additive into cement mixing tank 24. The illustrated hopper system 26 also comprises a hopper 30 mounted on feeder 28. For example, the hopper 30 may be mounted directly over feeder 28 to guide additive into an upper opening of the feeder 28. The additive, e.g. a fibrous fluid-loss reduction additive, can be poured into an upper hopper opening 32, and hopper 30 is designed to guide the additive to feeder 28.

Figure 2:
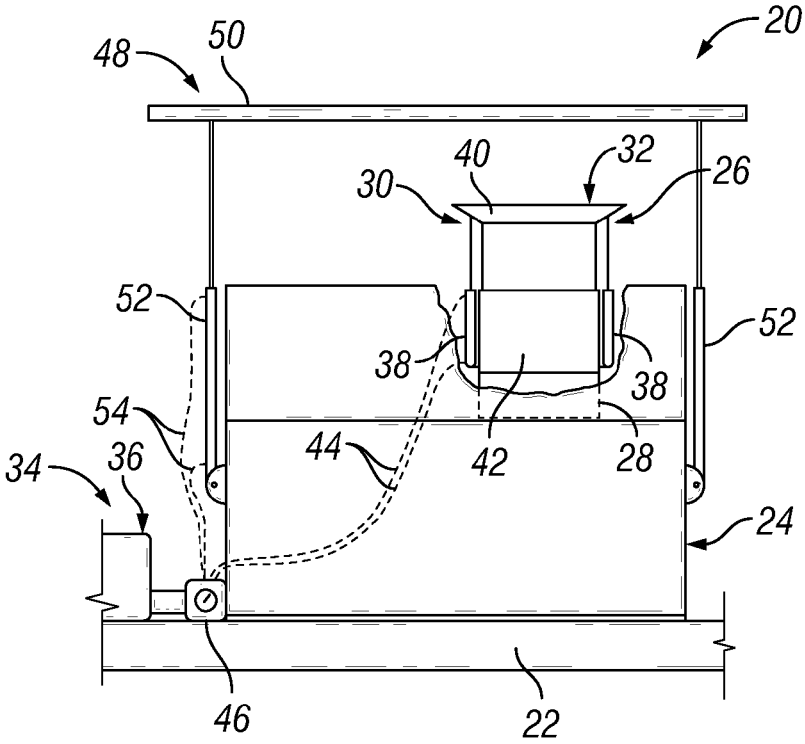
FIG. 2 is a schematic illustration similar to that of FIG. 1 but showing the transportable cementing unit in an expanded configuration.

Hopper 30 may be designed as an adjustable hopper that can be actuated between a contracted configuration, as illustrated in FIG. 1, and an expanded configuration, as illustrated in FIG. 2. Expansion of the hopper 30 increases the capacity of the hopper and enables loading of the hopper with a predetermined amount of additive material. For example, hopper 30 may be designed so that in its expanded configuration a standard bag of fiber based additive can be poured in its entirety into the hopper 30. Additionally, the ability to contract hopper 30 decreases the height of the overall transportable cementing unit 20, at least in the embodiments in which hopper system 26 is mounted on top of cement mixing tank 24. The contracting or lowering of hopper 30 facilitates meeting the legal height requirements imposed on vehicles traveling on a variety of public highway systems.

The expansion and contraction, e.g. raising and lowering, of hopper 30 can be accomplished automatically with an actuation system 34. By way of example, actuation system 34 comprises a pressure system 36 that directs fluid under pressure to cylinders 38 which are mounted between a movable portion 40 of hopper 30 and a stationary portion 42. Fluid is delivered from pressure system 36 to cylinders 38 and returned from cylinders 38 via pressure lines 44. Additionally, a valve or valves 46 can be used to control the flow of pressure fluid and thus the actuation of cylinders 38. In the illustrated example, cylinders 38 are dual acting cylinders to enable both the controlled expansion and contraction of hopper 30. In a variety of specific applications, pressure system 36 comprises a pneumatic pressure system using air or other appropriate fluid to actuate pneumatic cylinders 38. However, pressure system 36 also may be formed as a hydraulic pressure system.

Transportable cementing unit 20 also may comprise a canopy system 48 to provide a covering during operation of hopper system 26 and cement mixing tank 24. By way of example, canopy system 48 comprises a movable canopy 50 that can be raised to a working configuration, as illustrated in FIG. 2, or lowered to a transport configuration, as illustrated in FIG. 1. In the embodiment illustrated, canopy 50 is raised and lowered via cylinders 52 mounted between, for example, canopy 50 and cement mixing tank 24 or other suitable structure. Cylinders 52 may be powered by pressure system 36 and may comprise, for example, hydraulic or pneumatic cylinders.

In an embodiment, pressure system 36 is a pneumatic pressure system coupled to hopper 30 via pressure lines 44 and to cylinders 52 of canopy system 48 via pressure lines 54. The pressure lines 44 and 54 can be connected to a common valve 46 that enables actuation of both canopy system 48 and hopper system 26 by adjusting a single valve. For example, when the transportable cementing unit 20 is deployed at a well site and set up for a cementing operation, valve 46 can be opened to both raise canopy 50 and expand hopper 30. Upon completion of the cementing operation, valve 46 can be reversed to move hopper 30 into the contracted configuration and canopy 50 into the lowered position for transport. The actuation may be timed so that the canopy rises before the hopper and lowers after the hopper is moved to its contracted configuration.

Figure 3:
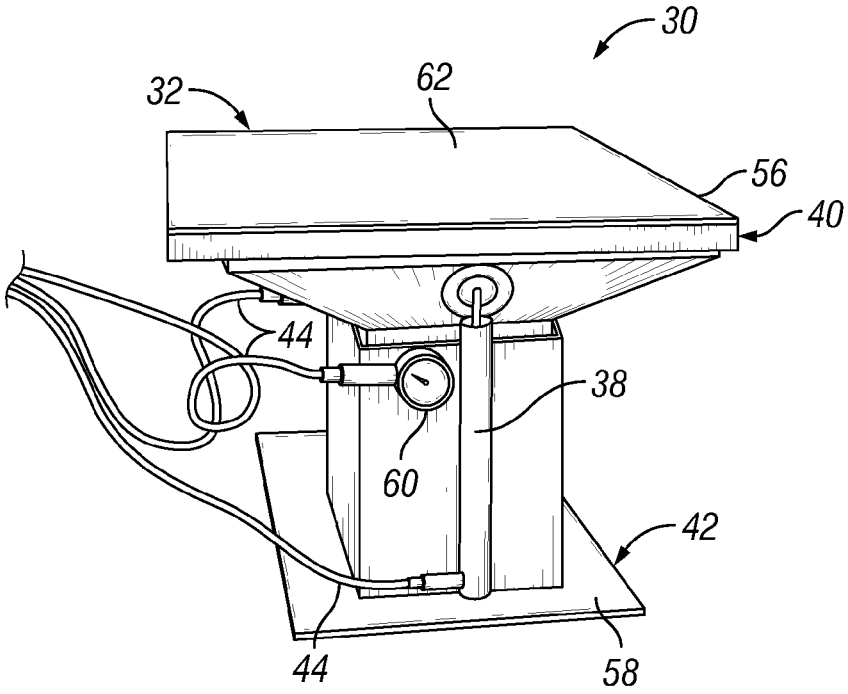
FIG. 3 is an orthogonal view of one embodiment of a hopper in a contracted position.
Figure 4:
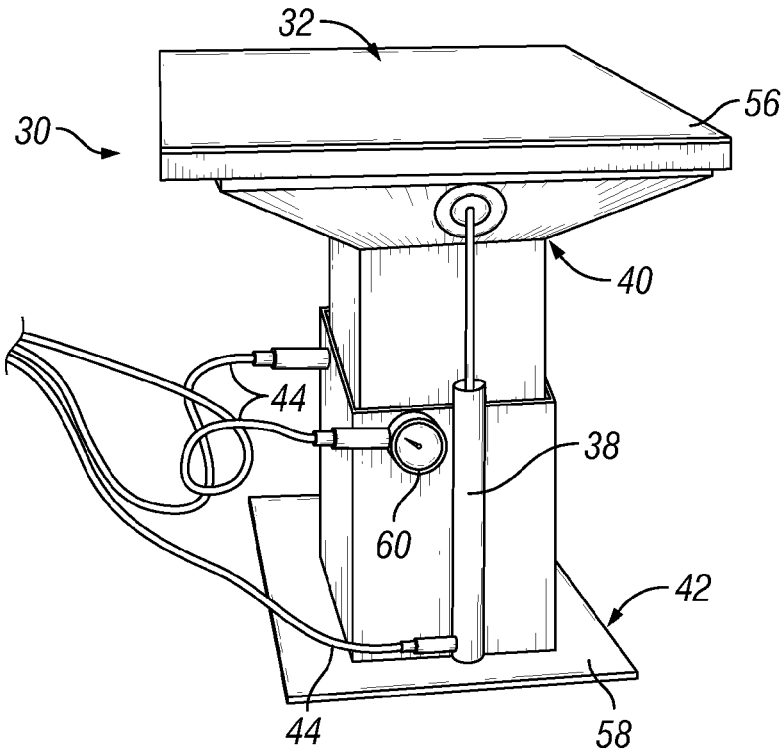
FIG. 4 is an orthogonal view of one embodiment of a hopper in an expanded position.

Referring generally to FIG. 3, one embodiment of hopper 30 is illustrated. In this embodiment, hopper 30 is a pneumatically actuated hopper that may be actuated from the contracted configuration of FIG. 3 to the expanded configuration of FIG. 4 by two dual acting pneumatic cylinders 38. The expansion and contraction are accomplished by forming the hopper as a telescopic hopper in which movable portion 40 is telescopically received in stationary portion 42. The cylinders 38 extend between a flared portion 56 of the movable portion 40 and a base portion 58 of the stationary portion 42. The dual acting cylinders 38 enable the controlled expansion and contraction of hopper 30 as portion 40 is moved telescopically outward and inward, respectively, with respect to stationary portion 42.

In the embodiment illustrated and in other embodiments of hopper 30, a variety of alternate or additional components can be incorporated into the design. For example, one or more pressure gauges 60 may be deployed along the lines 44 to monitor pressure applied to cylinders 38. Additionally, the hopper opening 32 may incorporate a grate 62 or other structure to break up the additive material as it is poured into hopper 30 through opening 32. Additionally, hopper 30 may be formed from a variety of materials that provide suitable longevity and consistent actuation when used with the desired additive in a variety of well site environments. In an embodiment, movable portion 40 and stationary portion 42 are formed from stainless steel, however other materials and combinations of materials may be employed.

Figure 5:
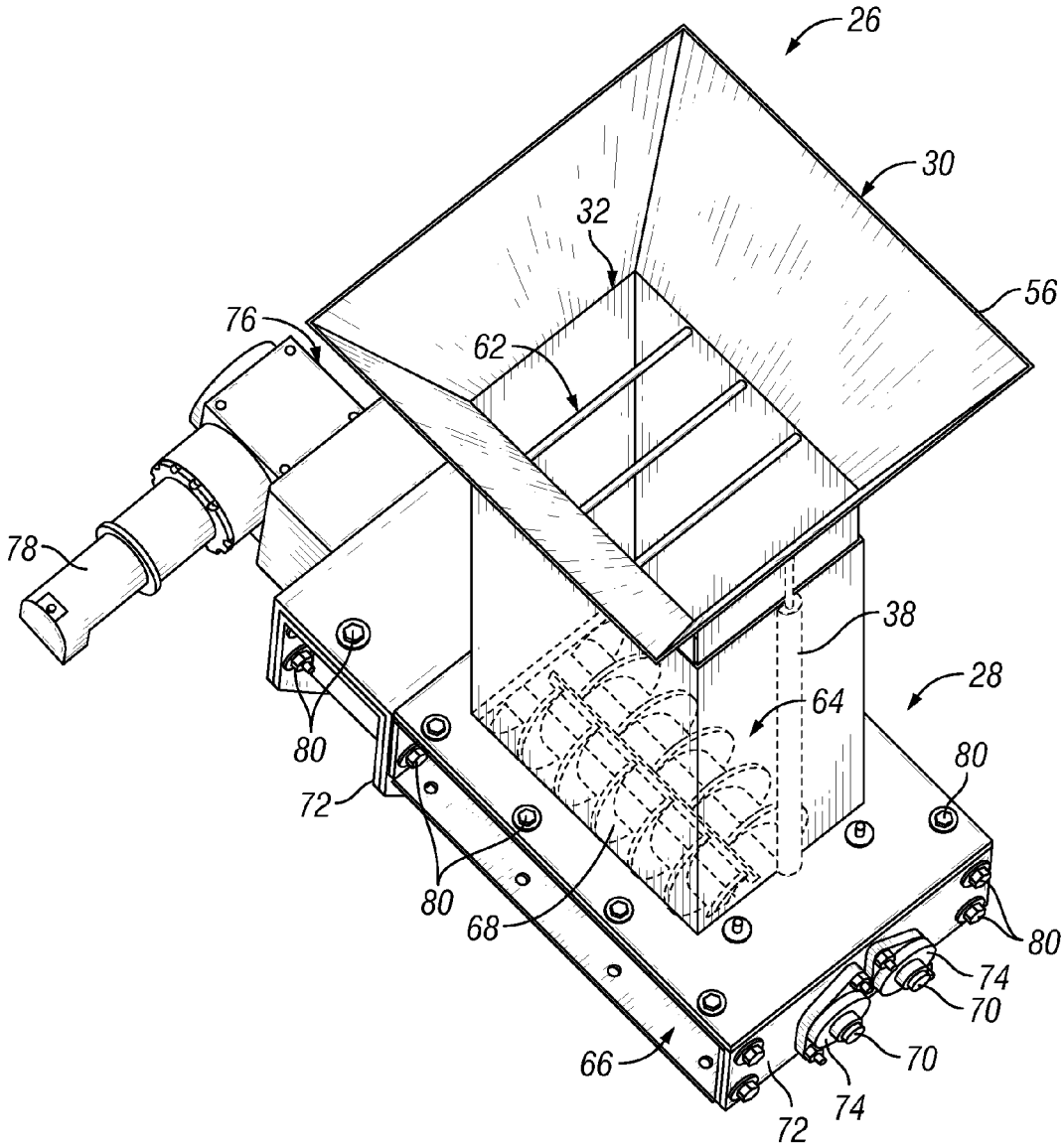
FIG. 5 is an illustration of one example of a hopper system.

As further illustrated in FIG. 5, the hopper 30 may be mounted directly over feeder 28 to create hopper system 26. In this embodiment, feeder 28 comprises an inlet 64 which may be in the form of an upper opening positioned beneath hopper 30 to receive the additive directed through hopper 30. The feeder 28 is designed to accurately meter the desired amount of additive at the desired rate into cement mixing tank 24.

Figure 6:
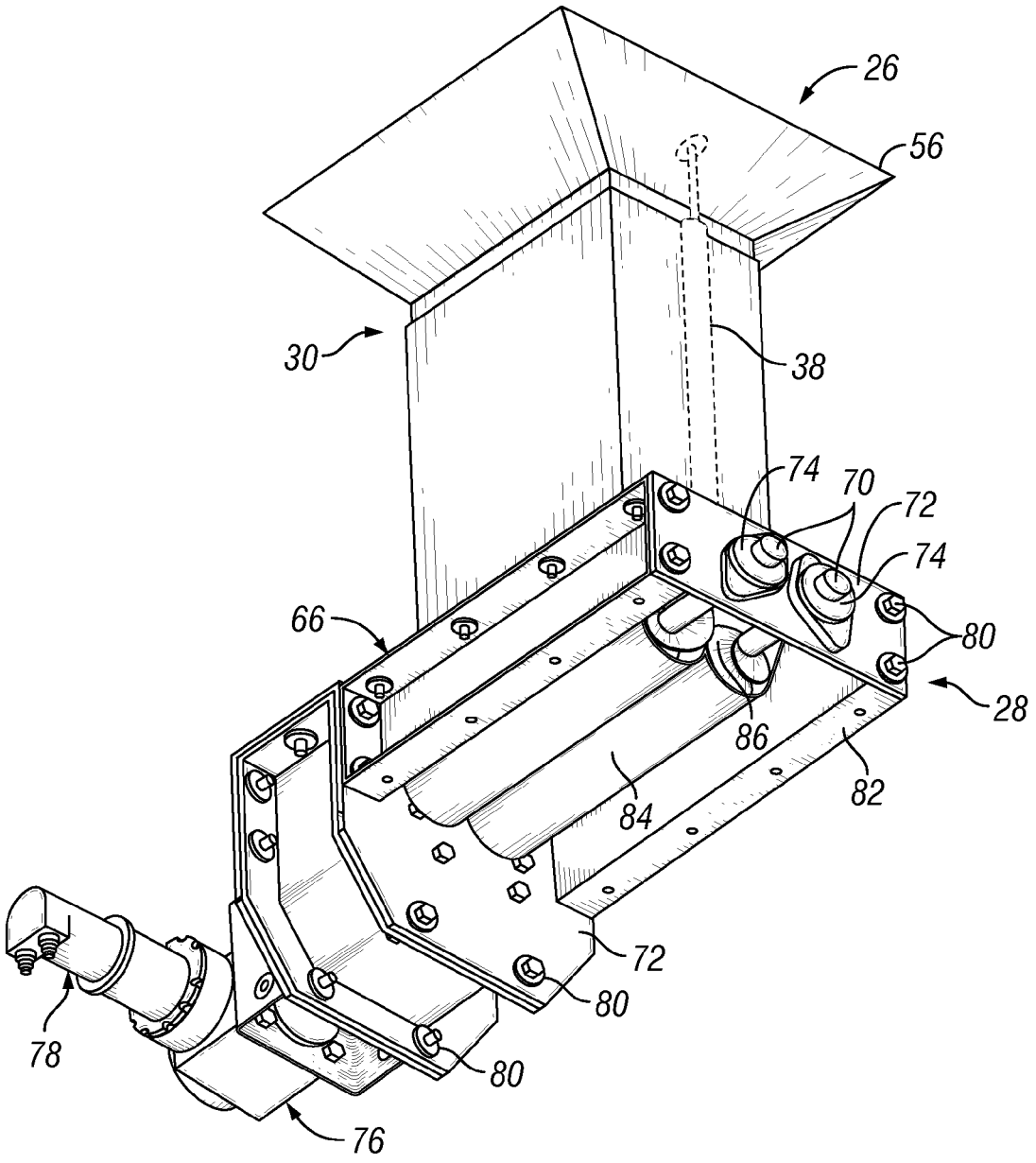
FIG. 6 is another illustration of the hopper system illustrated in FIG. 5.
Figure 7:
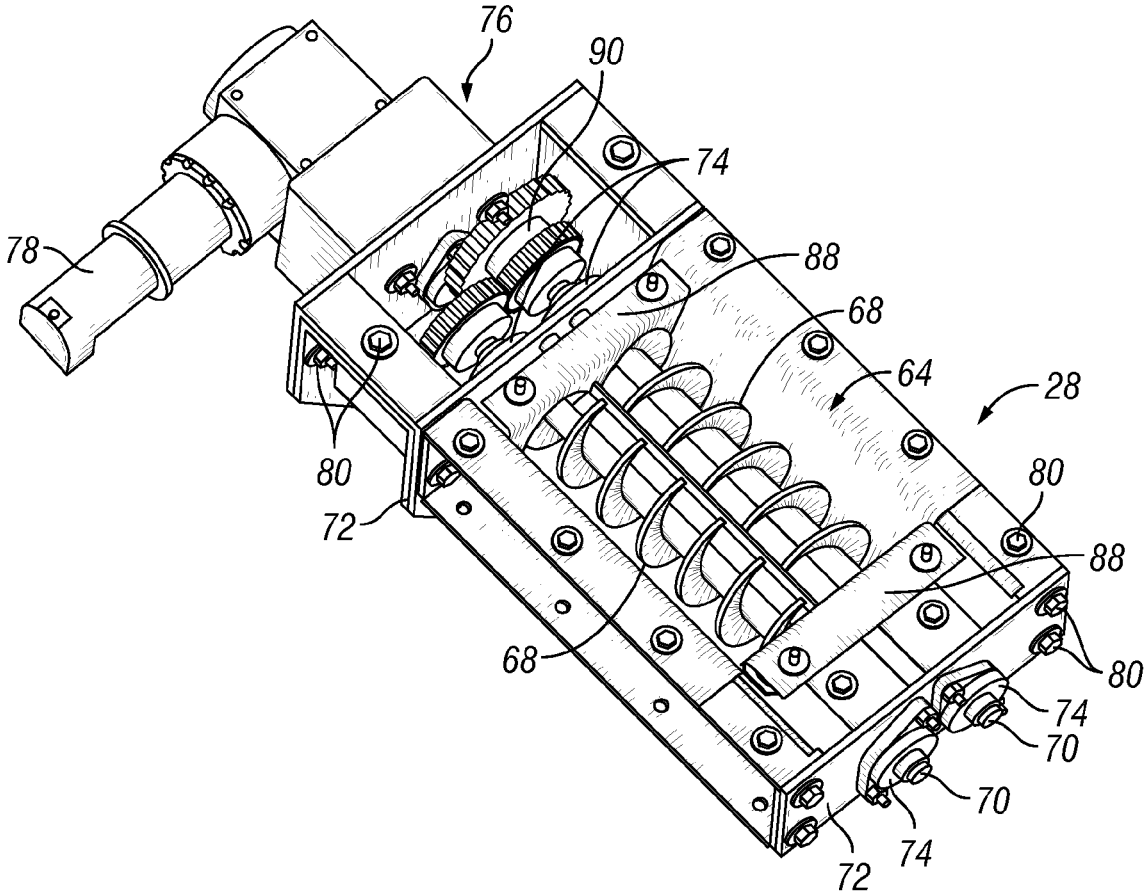
FIG. 7 is an illustration of one example of a feeder that can be used in the hopper system illustrated in FIG. 5.

In the embodiment illustrated, feeder 28 comprises a feeder body 66 containing at least one screw 68 for moving additive along feeder body 26 before discharging it into cement mixing tank 24, as further illustrated in FIGS. 6 and 7. The at least one screw 68 may comprise a constant pitch screw in the form of an auger rotated within feeder body 66. In the embodiment illustrated, dual screws 68 are utilized, and both of the screws may be constant pitch augers. The screws 68 may be formed of stainless steel or other suitable materials. As further illustrated, each screw 68 comprises a central shaft 70 that extends through opposite end plates 72 of feeder body 66 for receipt in corresponding bearings 74.

The screws 68 are rotated by a gearbox 76 which may be mounted adjacent one of the end plates 72 and coupled with shafts 70. The gearbox 76 may be powered by a suitable motor 78, such as a hydraulic motor or an electric motor. In one example, gearbox 76 has a high gearbox drive ratio, and motor 78 comprises a small volumetric displacement hydraulic motor that provides great control at low speeds.

Each of the feeder components is designed to function well with the desired additive. For example, the dual screws 68 and open inlet 64 may be arranged in a compact, low-profile design and used in cooperation with hopper 30 to provide a functionally effective construction for use with fiber products, such as fibrous fluid-loss reduction additives, such as those recited in U.S. Pat. Nos. 7,267,173 and 7,331,391, the entire disclosures of each of which are incorporated by reference in their entirety. Component materials also can be selected to facilitate the controlled and consistent movement of additive through both hopper 30 and feeder 28. In various applications, feeder body 66 may be formed from stainless steel, for example, to reduce friction and to discharge any build up of static electricity. Additionally, gearbox 76, motor 78, hopper 30, screws 68, and feeder body 66 (including end plates 72) can be constructed as modular components held together by a variety of fasteners 80. This high degree of modularity provides ease of assembly and disassembly when desired for initial construction, cleaning, repair, or other related operations.

Referring to FIG. 6, a feeder outlet 82 is illustrated as positioned to allow the additive to move through feeder 28 and into cement mixing tank 24. In the specific embodiment illustrated, the bottom side of screws 68 is shrouded by a shell 84 that may be a modular shell formed of a suitable material, such as stainless steel. The shell 84 wraps around the lower side of screws 68 to guide the additive material driven by screws 68 to an additive discharge opening 86. Rotation of the screws 68 drives the additive material along the interior of shell 84 and discharges it through discharge opening 86 so the material can fall through feeder outlet 82 into cement mixing tank 24.

The feeder 28 may be constructed in a variety of sizes and configurations with various components to facilitate metering of additive material. For example, one or more flow control inserts 88 can be mounted in feeder body 66 to facilitate flow from hopper 30 into screws 68, as illustrated in FIG. 7. In the specific example illustrated, flow control inserts 88 are removably mounted in feeder body 66 and may be formed of variable geometry to regulate movement of fiber additive or other types of additives. Depending on the additive material and the environment in which feeder 28 is used, flow control inserts 88 may be made from a variety of suitable materials, including stainless steel.

Motor 78 and gearbox 76 also may have a variety of forms and configurations. In the embodiment illustrated in FIG. 7, for example, gearbox 76 is a right angle gearbox having internal gearing 90 arranged to rotate dual screws 68 in opposite directions. The internal gearing 90 can be changed to adjust the speed of rotation and to accommodate different numbers of screws 68 in other embodiments of feeder 28.

The system 20 is useful in a variety of cementing operations including, but not limited to, foamed cementing operations and a variety of well environments. The system 20 may be utilized for providing an additive to a variety of well servicing fluid including, but not limited to, drilling mud or drilling fluid, a foamed cement mixture, an acidizing mixture, a proppant additive, such as a coating additive, or other well servicing fluids for delivery into a wellbore, as will be appreciated by those skilled in the art. In one example of a methodology for using transportable cementing unit 20 and hopper system 26, the transportable cementing unit 20 is driven to a well site for performance of a servicing operation. Once properly located at the well site, the hopper 30 is actuated to its expanded position to accommodate a desired amount of fibrous fluid-loss reduction additive. The additive is placed into hopper 30, and feeder 28 is operated to meter a controlled amount of the fibrous fluid-loss reduction additive into cement mixing tank 24 of the transportable cementing unit 20. The cement mixing tank is operated to mix in the additive and to form a desired cement slurry for a well cementing operation. Subsequently, the cement slurry is delivered downhole to a desired region of the wellbore to complete performance of the cementing operation. Once the cementing operation is completed, hopper system 26 can be converted to its contracted configuration and, if applicable, canopy 50 can be lowered to facilitate transport of the transportable cementing unit.

The actual configuration of hopper system 26 and the overall transportable cementing unit 28 may vary depending on the additive or additives involved, the goals of the servicing operation, and the environment in which the operation is conducted. For example, the size and type of components used to construct hopper system 26 may vary depending on the specific application. Additionally, the materials used to form the various components may be different from one application to another, depending on the environment, the additive, and other factors affecting the cementing operation. The methodology of operating the hopper system and the cementing unit, as well as the methodology for mixing materials to form the cement slurry, can be adjusted and varied for different applications.

Accordingly, although only a few embodiments have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of operating a well cementing unit, comprising: automatically expanding the capacity of an expandable hopper that is open to the atmosphere and is able to accommodate a predetermined amount of fibrous fluid-loss reduction additive, the hopper being positioned above a feeder equipped with integral constant-pitch dual screws; delivering the fibrous fluid-loss reduction additive into the hopper; and operating the feeder to meter the fibrous fluid-loss reduction additive into a mixing tank of a transportable cementing unit, the mixing tank being located below the feeder.

2. The method as recited in claim 1, further comprising a pressure system coupled to the hopper, wherein pressurized fluid delivered by the pressure system is used to move the hopper between a contracted position and an expanded position.

3. The method as recited in claim 2, wherein a canopy is coupled to the pressure system, wherein pressurized fluid delivered by the pressure system is used to move the canopy between a lowered transport position and a raised position.

4. The method as recited in claim 3, wherein flow of hydraulic fluid to expand the hopper and to raise the canopy is controlled by a single valve.

5. A method for use in well servicing operations, comprising: delivering a fibrous additive into a hopper that is open to the atmosphere and mounted on a transportable well servicing unit; automatically expanding the capacity of the hopper to guide the additive into a feeder positioned below and equipped with integral dual screws; and operating the feeder to meter the fibrous additive into a mixing tank at a controlled rate.

6. The method as recited in claim 5, wherein automatically expanding comprises using a hydraulic pressure system to actuate the hopper to a larger capacity.

7. The method as recited in claim 5, wherein operating comprises rotating the dual screws.

8. The method of claim 1, wherein the constant pitch dual screws are formed as stainless steel augers.

9. The method of claim 1, wherein the feeder comprises a stainless steel body.

10. The method of claim 1, wherein the feeder comprises at least one flow control insert to regulate movement of the dry additive.

11. The method of claim 1, wherein the feeder comprises a gearbox, having a high gearbox drive ratio, coupled to the constant pitch dual screws.

12. The method of claim 1, wherein the feeder comprises a hydraulic motor driving the gearbox.

13. The method of claim 1, wherein the mixing tank comprises a cement mixing tank.

14. The method as recited in claim 1, wherein the hopper is telescopic.

15. The method as recited in claim 1, further comprising mixing a cement slurry in the mixing tank.

16. The method as recited in claim 15, further comprising delivering the cement slurry downhole to perform a cementing operation.

* * * * *